US010820404B2

(12) United States Patent
Cross et al.

(10) Patent No.: US 10,820,404 B2
(45) Date of Patent: Oct. 27, 2020

(54) NEUTRON GENERATOR WITH A ROTATING TARGET IN A VACUUM CHAMBER

(71) Applicant: General Electric Company, Schenectady, NY (US)

(72) Inventors: Andrew Thomas Cross, Waterford, NY (US); Alexander Kagan, Guilderland, NY (US); Thomas Raber, East Berne, NY (US); Vasile Bogdan Neculaes, Niskayuna, NY (US); Nidhishri Tapadia, Glenville, NY (US); Ashraf Atalla, Portland, OR (US); Pierre Fernand Habig, Rambouillet (FR); Frederic Dahan, Le Chesnay (FR)

(73) Assignee: GENERAL ELECTRIC COMPANY, Niskayuna, NY (US)

( * ) Notice: Subject to any disclaimer, the term of this patent is extended or adjusted under 35 U.S.C. 154(b) by 199 days.

(21) Appl. No.: 16/106,688

(22) Filed: Aug. 21, 2018

(65) Prior Publication Data

US 2020/0068698 A1 Feb. 27, 2020

(51) Int. Cl.

| | |
|---|---|
| ***H05H 6/00*** | (2006.01) |
| ***H05H 3/04*** | (2006.01) |
| ***H05H 3/06*** | (2006.01) |
| *G21G 4/02* | (2006.01) |

(52) U.S. Cl.

CPC ..... *H05H 6/00* (2013.01); *H05H 3/04* (2013.01); *H05H 3/06* (2013.01); *G21G 4/02* (2013.01)

(58) Field of Classification Search

CPC .. H05H 6/00; H05H 3/04; H05H 3/06; G21G 4/02

USPC ..... 376/114, 115

See application file for complete search history.

(56) References Cited

U.S. PATENT DOCUMENTS

| | | | |
|---|---|---|---|
| 3,733,490 | A | 5/1973 | Roche |
| 4,119,858 | A | 10/1978 | Cranberg |
| 4,360,495 | A | 11/1982 | Bauer |

(Continued)

OTHER PUBLICATIONS

Wang, "A comparative study between pure titanium and titanium deuteride targets used for neutron generator", Surface and Coatings Technology 228 (2013): S142-S145. (Year: 2013).*

(Continued)

*Primary Examiner* — Jack W Keith
*Assistant Examiner* — Daniel Wasil
(74) *Attorney, Agent, or Firm* — Fletcher Yoder, P.C.

(57) ABSTRACT

A portable neutron generator is provided that does not utilize liquid cooling. The portable neutron generator includes a vacuum chamber housing defining a vacuum chamber and an ion beam inlet. The portable neutron generator also includes a rotating target positioned within the vacuum chamber. The ion beam inlet is oriented to receive ions such that the ions impinge upon the rotating target to cause neutrons to be emitted. The rotating target comprises a copper alloy. The portable neutron generator also includes a motor core positioned within the vacuum chamber and coupled to the rotating target. A motor stator is electromagnetically coupled with the motor core. The motor core is configured to rotate the rotating target at greater than 200 Hz during operation.

18 Claims, 6 Drawing Sheets

(56) References Cited

U.S. PATENT DOCUMENTS

| | | | | |
|---|---|---|---|---|
| 4,582,667 | A * | 4/1986 | Bauer | H05H 6/00 376/151 |
| 5,519,225 | A | 5/1996 | Mohr et al. | |
| 5,548,628 | A | 8/1996 | Eggleston et al. | |
| 7,903,786 | B2 * | 3/2011 | Zhong | H01J 35/105 378/129 |
| 2009/0146052 | A1 | 6/2009 | Groves et al. | |
| 2011/0114830 | A1 | 5/2011 | Reijonen et al. | |
| 2014/0029709 | A1 | 1/2014 | Gahl et al. | |
| 2014/0177808 | A1 | 6/2014 | Charette et al. | |
| 2020/0196428 | A1 * | 6/2020 | Ryding | G21G 4/02 |

OTHER PUBLICATIONS

Booth et al., "Rotating Target Neutron Generators", Nuclear Instruments and Methods, http://www.sciencedirect.com/science/article/pii/0029554X77905559, vol. 145, Issue 01, pp. 25-39, Aug. 15, 1977.

Komeda et al., "Neutron Generator Using Spherical Targets on a Rotating Disk Irradiated with an Ultraintense Laser at 1.25 Hz", Fusion Science and Technology, http://www.tandfonline.com/doi/abs/10.13182/FST13-A16353, vol. 63, Issue 02, pp. 296-300, May 20-24, 2012.

Vala et al., "Rotating Tritium Target for Intense 14-MeV Neutron Source", Fusion Engineering and Design, http://www.sciencedirect.com/science/article/pii/S0920379617306750, Jun. 2, 2017.

* cited by examiner

NEUTRON GENERATOR WITH A ROTATING TARGET IN A VACUUM CHAMBER

STATEMENT REGARDING FEDERALLY SPONSORED RESEARCH AND DEVELOPMENT

This invention was made with Government support under contract number HR0011-15-C-0072 awarded by DARPA. The Government has certain rights in this invention.

BACKGROUND

The subject matter described herein relates generally to neutron imaging and, more particularly, to compact neutron sources.

In neutron imaging, a neutron source is used to generate neutrons for imaging an object. In at least some known systems, a beam of accelerated particles is directed towards a rotating neutron target. However, in such systems, to cool the rotating neutron target, cooling fluid is actively pumped through a vacuum chamber containing the rotating neutron target, and rotating seals are used to facilitate the cooling, increasing the complexity and cost of such systems. Further, at least some known neutron imaging systems include a relatively large neutron source (e.g., a nuclear reactor). Thus, in such systems, the object to be imaged must be moved to the neutron source.

In addition, similar to the architecture of neutron sources, at least some known x-ray generation systems include an electron beam directed towards a rotating x-ray target. However, rotating x-ray targets are subject to substantially different design constraints than rotating neutron source targets (e.g., rotating x-ray targets operate at significantly higher temperatures than rotating neutron targets). Accordingly, designing a rotating neutron target based on an existing rotating x-ray target, without making substantial modifications, would result in a deficient neutron target.

It would be desirable to have a compact neutron source that could be moved to an object to be imaged. This would facilitate neutron imaging of objects that are generally too large or immobile to be imaged by neutron imaging systems including large neutron sources. Further, temperature, size, and power consumption considerations must all be taken into account for a compact neutron source.

BRIEF DESCRIPTION

In one aspect, an apparatus is provided. The apparatus includes a compact vacuum chamber housing defining a vacuum chamber and an ion beam inlet, a rotating target positioned within the vacuum chamber, the ion beam inlet oriented to receive ions such that the ions impinge upon the rotating target, a motor core positioned within the vacuum chamber and coupled to the rotating target, and a motor stator electromagnetically coupled with the motor core.

In another aspect, a system is provided. The system includes an ion source, an ion accelerating structure coupled to the ion source, a compact vacuum chamber housing coupled to the ion accelerating structure, wherein the compact vacuum chamber housing defines a vacuum chamber and an ion beam inlet, and wherein the ion source, the ion accelerating structure, and the compact vacuum chamber housing cooperatively define a sealed vacuum environment including the vacuum chamber, a rotating target positioned within the vacuum chamber, the ion beam inlet oriented to receive ions such that the ions impinge upon the rotating target; a motor core positioned within the vacuum chamber and coupled to the rotating target, and a motor stator electromagnetically coupled with the motor core.

DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "about," "substantially," and "approximately," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The systems and methods described herein provide an apparatus that may be used with a compact neutron source. The apparatus includes a compact vacuum chamber housing defining a vacuum chamber and an ion beam inlet. The apparatus further includes a rotating target positioned within the vacuum chamber. The ion beam inlet is oriented to receive ions such that the ions impinge upon the rotating target. The apparatus further includes a motor core positioned within the vacuum chamber and coupled to the rotating target, and a motor stator electromagnetically coupled with the motor core.

Figure 1:
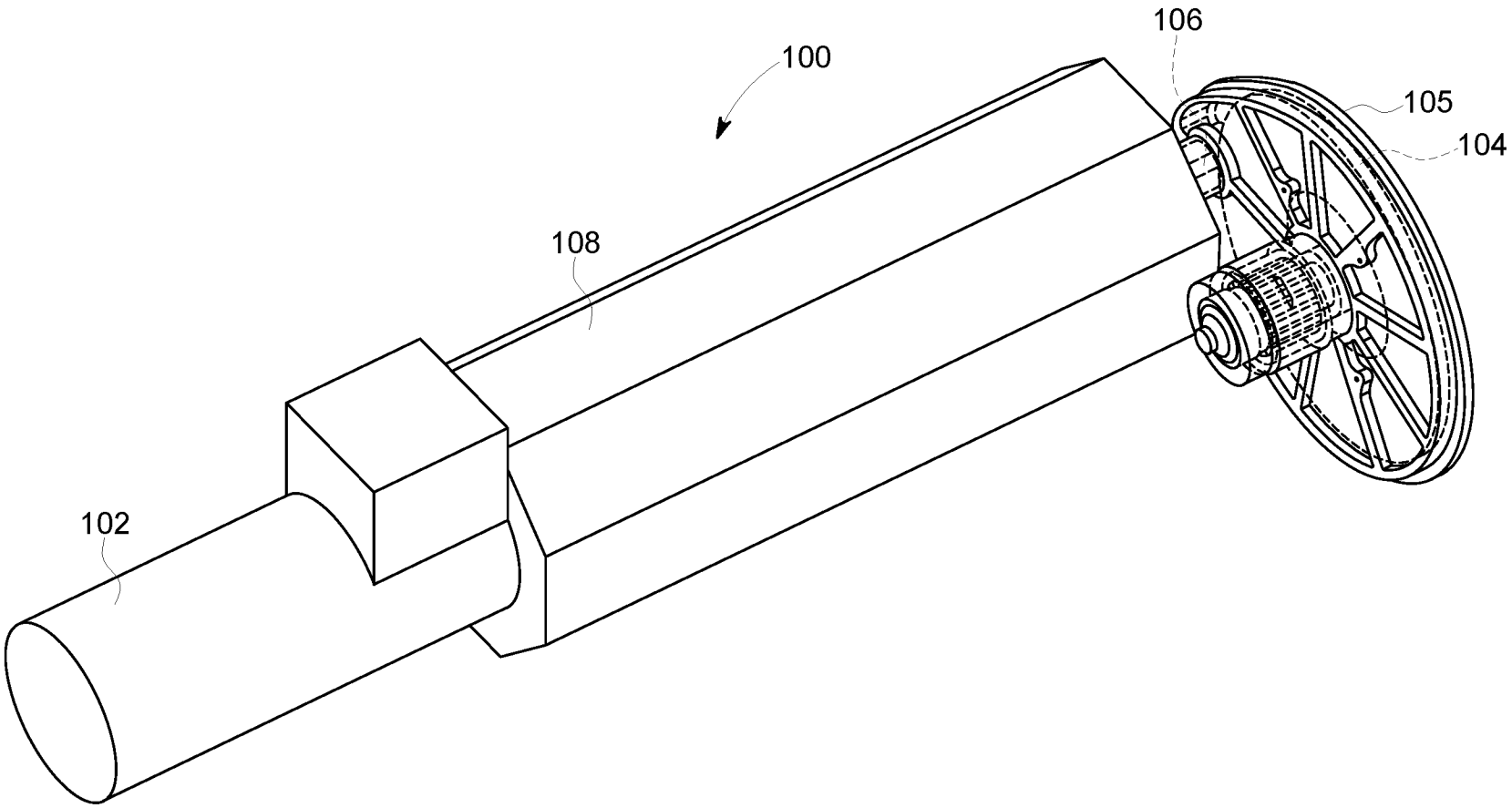
FIG. 1 is a perspective view of an exemplary neutron source in accordance with the embodiments described herein.

FIG. 1 is a perspective view of an exemplary neutron source 100 in accordance with the embodiments described herein. In the exemplary embodiment, neutron source 100 is a relatively compact neutron source that is portable and may, for example, be carried by a user. Neutron source 100 includes an ion source 102 and a neutron source target 104 (described in detail below).

Neutron source target 104 is positioned within a vacuum chamber housing 105. To clearly show the position of neutron source target 104, in FIG. 1, vacuum chamber housing 105 is shown as partially transparent. To generate neutrons, ion source 102 generates a hydrogen isotope ion beam 106 that is incident on neutron source target 104 after passing through an ion accelerating structure 108. Ion beam 106 may be continuous, or pulsed (e.g., to maintain high energy transfer while reducing overall energy requirements). When ions in ion beam 106 strike neutron source target 104, a nuclear reaction occurs, generating neutrons. As described below, neutron source target 104 generally includes a rotatable disk coupled to a motor. During operation, the disk rotates to prevent overheating of a single point and to distribute a thermal load. Further, a bearing structure facilitates rotation of the disk. The bearing structure may include rolling element bearings or hydrodynamic fluid film bearings, for example.

In the exemplary embodiment, neutron source target 104 is in a sealed vacuum chamber. Specifically, vacuum chamber housing 105, ion source 102, and ion accelerating structure 108 cooperatively form a sealed vacuum environment (including the sealed vacuum chamber inside vacuum chamber housing 105), such that ion beam 106 and neutron source target 104 are located entirely within the sealed vacuum environment. Vacuum chamber housing 105, ion source 102, and ion accelerating structure 108 may maintain a vacuum at a pressure of about 10e-3 Torr or less in the vacuum chamber. For example, the vacuum may have a pressure of approximately 10e-5 Torr in some embodiments.

Neutron source 100 may generate neutrons, for example, for use in neutron imaging. Because neutron source 100 is portable, neutron source 100 can be moved to components to be imaged (instead of requiring that such components be moved to neutron source 100).

Figure 2:
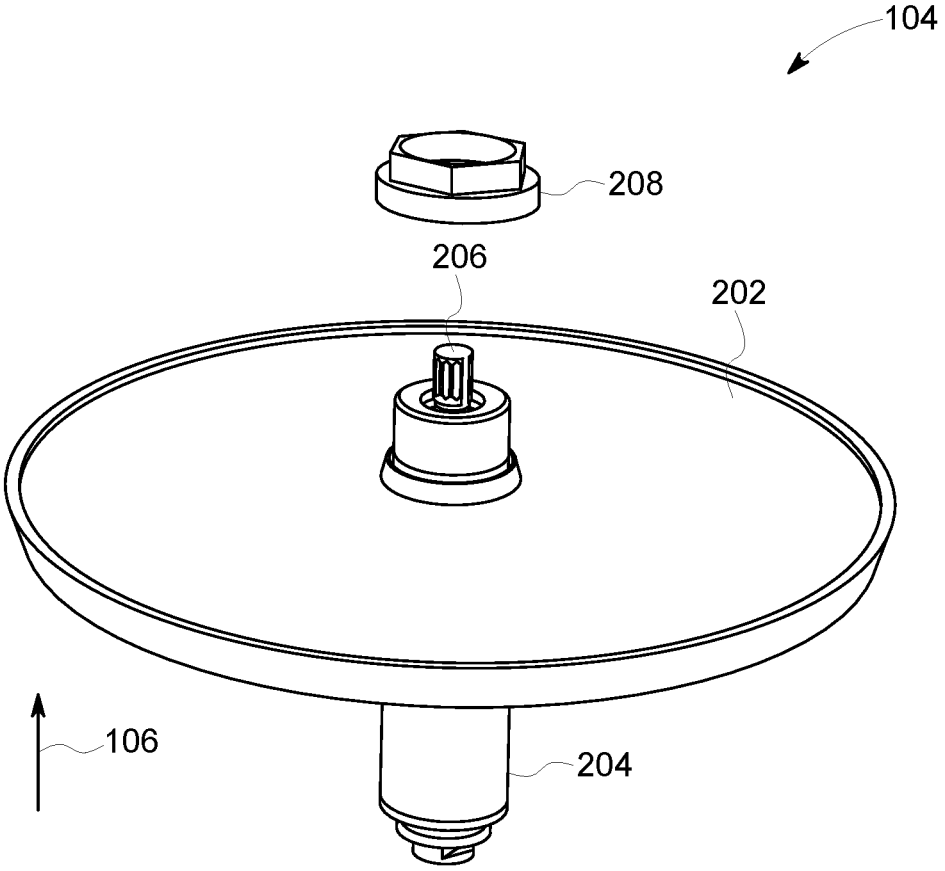
FIG. 2 is a perspective view of an exemplary neutron source target included in the neutron source shown in FIG. 1.

FIG. 2 is a perspective view of neutron source target 104. As shown in FIG. 2, in the exemplary embodiment, neutron source target 104 includes a rotating target, such as a disk 202, coupled to a motor core 204 operable to rotate disk 202, however, other methods to secure disk 202 to motor core 204 may be used. In the exemplary embodiment, a nut 208 secures disk 202 to motor core 204. For clarity, nut 208 is shown separated from disk 202 in FIG. 2. Motor core 204 is electromagnetically coupled with a motor stator (not shown in FIG. 2) to form a motor. Disk 202 rotates about a shaft 206 using a bearing system (not shown in FIG. 2).

Above an upper temperature limit of disk 202, a coating material on disk 202 will begin to evaporate, reducing neutron production. Accordingly, it is desirable to keep the temperature of disk 202 below the upper temperature limit during exposure to ion beam 106 (which may have a varying energy). The upper temperature limit generally depends on the coating material used. For example, in some embodiments, the upper temperature limit may be approximately 300° C. Notably, this upper temperature limit is substantially lower than temperature limits in x-ray generation systems (which may be, for example, an order of magnitude higher, in a range from approximately 2000° C. to 2400° C.). Accordingly, to keep the temperature of disk 202 below the upper temperature limit, disk 202 is configured to rotate faster than a rotating x-ray target.

Rotating disk 202 allows a thermal load from ion beam 106 to be distributed and dissipated over a larger area, allowing a high beam intensity, and therefore more effective neutron generation. Spinning disk 202 at relatively high speeds spreads the thermal load to dissipate the heat from disk 202 to the surrounding vacuum chamber. Because of the high rotational speeds, disk 202 is passively cooled. That is, unlike at least some known neutron generation systems, neutron source target 104 does not require or include active cooling devices (e.g., cooling fluid pumps, rotating seals) for cooling. In the exemplary embodiment, to passively cool disk 202, motor core 204 is capable of rotating disk 202 up to speeds greater than 200 Hertz (Hz) (i.e., 12,000 revolutions per minute (RPM)). Further, disk 202 has a relatively large diameter (e.g., from approximately 200 to 300 millimeters (mm) in some embodiments) to facilitate dissipating thermal energy.

Further, in the exemplary embodiment, the motor including motor core 204 is a permanent magnet motor. Permanent magnet motors are advantageous, as they generally have a smaller footprint, lower input power, higher efficiency, reduced current draw, higher output power, and reduced heat generation as compared to at least some other motor types. Accordingly, using a permanent magnet motor enables neutron source 100 to be relatively compact. Notably, because x-ray generation systems operate at much higher temperatures (as described above), and permanent magnets are unstable at such temperatures, permanent magnet motors cannot be used for a rotating x-ray target. Thus, permanent magnet motors are uniquely well-matched for use with the neutron source targets described herein. However, in other embodiments, other types of motors (e.g., an induction motor, a synchronous reluctance motor, etc.) may be used.

Figure 3:
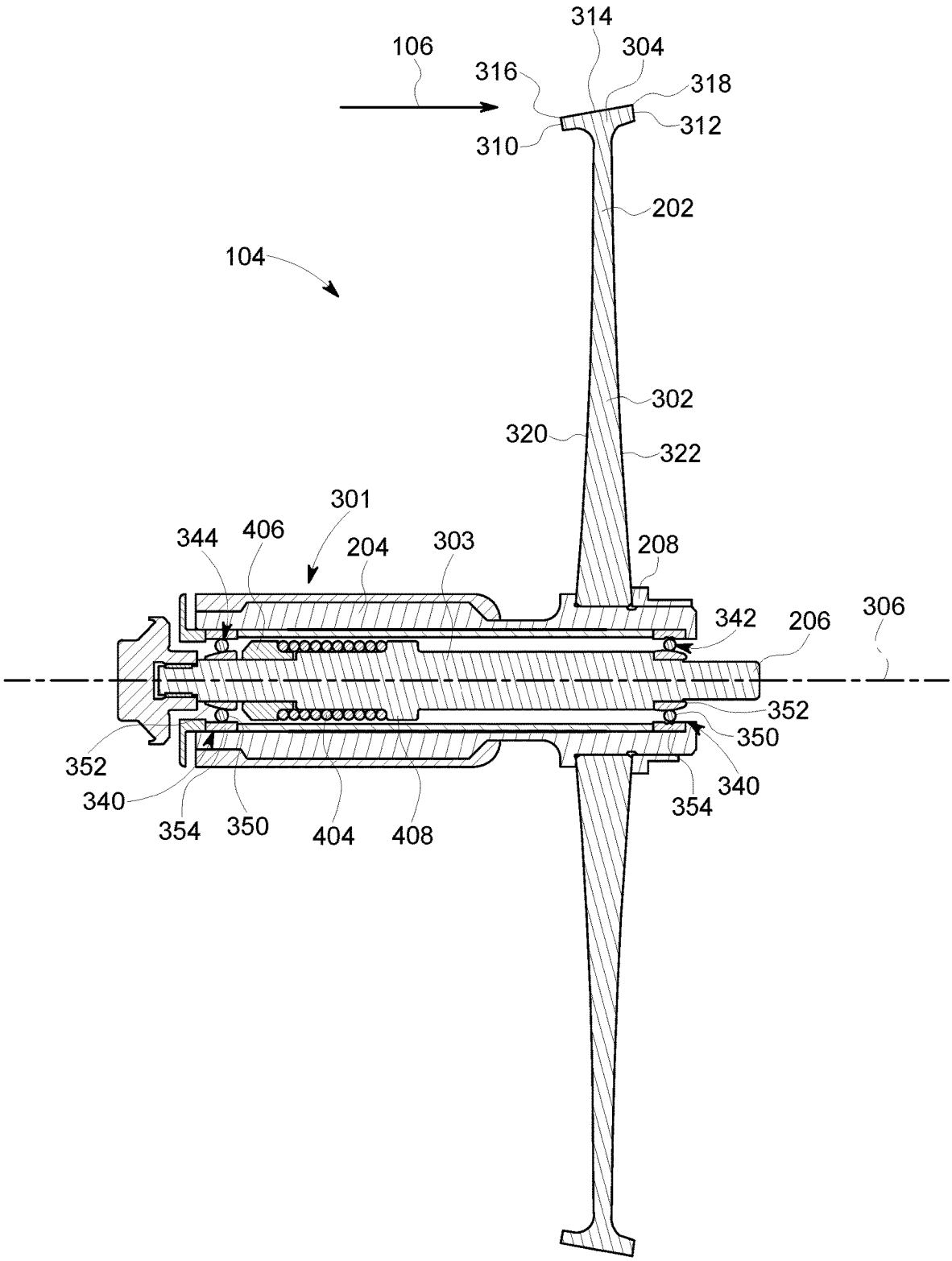
FIG. 3 is a cross-sectional view of the neutron source target shown in FIG. 2.

FIG. 3 is a cross-sectional view of neutron source target 104. In the exemplary embodiment, neutron source target 104 includes a rotating assembly 301 that rotates about a static assembly 303. Rotating assembly 301 includes disk 202 and motor core 204, and static assembly 303 includes shaft 206. As shown in FIG. 3, disk 202 includes a generally annular body 302 having an integrally formed rim 304. Relative to a longitudinal axis 306 of neutron source target 104, rim 304 is located radially outward from body 302. Disk 202 is formed of a material capable of effectively dissipating heat and withstanding rotational stresses during operation. For example, in some embodiments, disk 202 is fabricated from a material having a high thermal conductivity and sufficient mechanical strength. The high thermal conductivity enables distributing heat evenly around disk 202 and enables thermal energy to flow from disk 202 to motor core 204, cooling disk 202.

For example, disk 202 may be fabricated from a copper alloy, such as a copper zirconium (Cu—Zr) alloy or a copper chromium zirconium (Cu—Cr—Zr) alloy. In another example, disk 202 is fabricated from stainless steel. These materials are distinct from rotating x-ray targets, which are typically fabricated from refractory metals with high mechanical strength and low thermal conductivity. That is, in contrast to materials used for rotating x-ray targets, the materials used for disk 202 have a higher thermal conductivity and a lower mechanical strength. Further, the shape of disk 202 and the attachment of disk 202 to motor core 204, as described herein, at least partially compensate for the lower mechanical strength of the material of disk 202. In some embodiments, to further improve radiating thermal energy from disk, at least a portion of disk 202 is coated with an emissive material (e.g., having an emissivity between 0.8 and 0.9). The emissive material may be, for example, black paint.

In the embodiment shown in FIG. 3, Rim 304 includes a leading face 310 and a trailing face 312. An outer face 314 of rim 304 extends from leading face 310 to trailing face 312. In the exemplary embodiment, outer face 314 is tapered. That is, a leading edge 316 of outer face 314 is radially inward from a trailing edge 318 of outer face 314. In the exemplary embodiment, ion beam 106 is generally incident on outer face 314 of rim 304. The contact angle of ion beam 106 on outer face 314 facilitates spreading energy of ion beam 106 over a larger area to prevent localized over-heating. Outer face 314 further includes a coating (e.g., titanium deuteride ($Ti—H_2$)) to facilitate producing neutrons. Specifically, the ions in ion beam 106 fuse with the hydrogen in the material layer to produce neutrons.

Body 302 includes a leading surface 320 and an opposite trailing surface 322. Leading and trailing surfaces 320 and 322 are curved to facilitate spreading rotational stresses during operation. The geometry of rim 304 and body 302 facilitates reducing temperatures while increasing neutron generation. Disk 202 may be fabricated, for example, using a computer numerical controlled (CNC) lathe. Further, to counter warping, disk 202 may undergo one or more stress relieving processes (e.g., a high temperature anneal).

In the embodiment shown in FIG. 3, relative to ion beam 106, disk 202 is located downstream from the majority of motor core 204 and static assembly 303, such that ion beam 106 passes the majority of motor core 204 and static assembly 303 before impacting disk 202. Alternatively, disk 202 may be located upstream from the majority of motor core 204 and static assembly 303, such that ion beam 106 impacts disk 202 without first passing the majority of motor core 204 and static assembly 303. In such embodiments, the orientation of disk 202 relative to motor core 204 and static assembly 303 is reversed relative to the orientation shown in FIG. 3, such that ion beam 106 still impacts outer face 314.

Like disk 202, motor core 204 may also be coated with an emissive material to facilitate radiating thermal energy. In the exemplary embodiment, motor core 204 is steel, and is coupled to disk 202 via an interference fit using nut 208 to ensure concentricity and a relatively tight coupling. The interference fit is tight enough to prevent disk 202 from coming loose during rotation, but loose enough to avoid plastic deformation when disk 202 is at rest at cooler temperatures.

As shown in FIG. 3, at least one bearing assembly 340 rotatably couples rotating assembly 301 to static assembly 303. In the exemplary embodiment, neutron source target 104 includes two bearing assemblies 340: a forward bearing assembly 342 and a rear bearing assembly 344. In this embodiment, forward and rear bearing assemblies 342 and 344 are located on opposite sides of disk 202 to distribute loading of forward and rear bearing assemblies 342 and 344 by disk 202.

In the exemplary embodiment, each bearing assembly 340 is a silver lubricated, cageless, angular contact ball bearing with a plurality of balls 350 positioned between an inner race 352 coupled to shaft 206 and an outer race 354 coupled to motor core 204. In the embodiment shown in FIG. 3, static assembly 303 includes a spring 404 that seats against an annular shoulder 408 formed on shaft 206, and biases a slider mechanism 406 against inner race 352 of rear bearing assembly 344, pre-loading bearing assembly 340 and improving stiffness of the bearing coupling between rotating assembly 301 and static assembly 303.

In the exemplary embodiment, inner and outer races 352 and 354, as well as balls 350 are coated with silver to facilitate rotation. In other embodiments, the ball bearings may be replaced with a hydrodynamic gallium lubricated spiral groove bearing. In another embodiment, a gallium shunt may be used to supplement the ball bearings. The gallium shunt may facilitate transferring heat from rotating assembly 301 to shaft 206. For oil lubricated bearings, bearing assemblies 340 may be isolated from the vacuum chamber using a ferrofluidic seal. In contrast, bearing assemblies 340 with liquid metal bearings may be used directly within the vacuum chamber.

Figure 4:
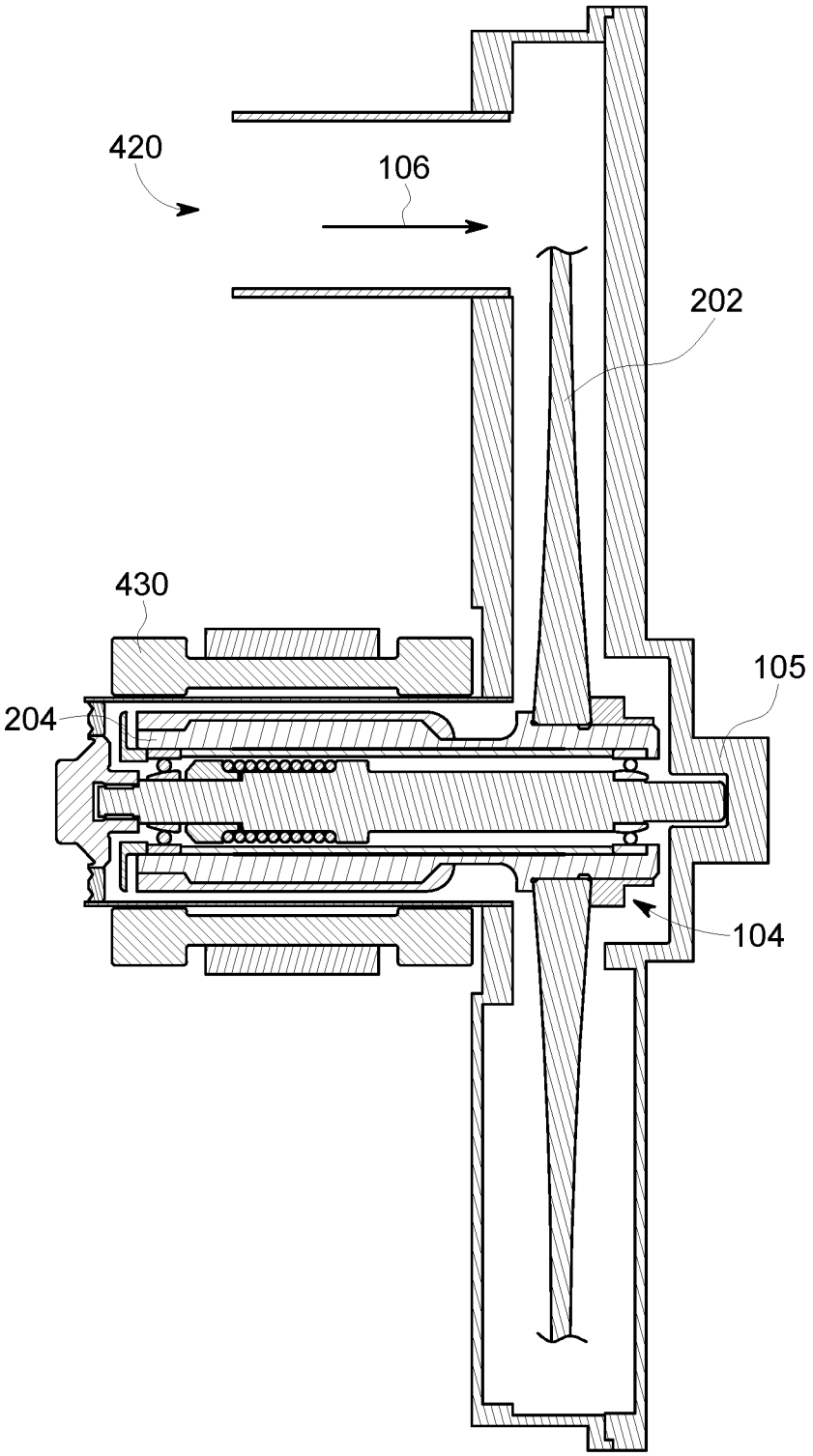
FIG. 4 is a cross-sectional view of the neutron source target shown in FIG. 3 within a vacuum chamber housing.

FIG. 4 is a cross-sectional view of neutron source target 104 within vacuum chamber housing 105. In FIG. 4, rim 304 is omitted to make clear that, within the scope of this disclosure, rim 304 may have a different geometry than that described in association with FIG. 3. As shown in FIG. 4, vacuum chamber housing 105 defines an ion beam inlet 420 through which ion beam 106 enters (from ion accelerating structure 108), such that ion beam 106 is incident on disk 202, as described herein. As described above, vacuum chamber housing 105, ion source 102 (shown in FIG. 1), and ion accelerating structure 108 (also shown in FIG. 1) cooperatively form a sealed vacuum environment. FIG. 4 also illustrates a motor stator 430 electromagnetically coupled to motor core 204. Specifically, to rotate disk 202, motor stator 430 generates a magnetic field to drive rotation of motor core 204. In the exemplary embodiment, motor stator 430 is positioned outside of vacuum chamber housing 105.

Figure 5:
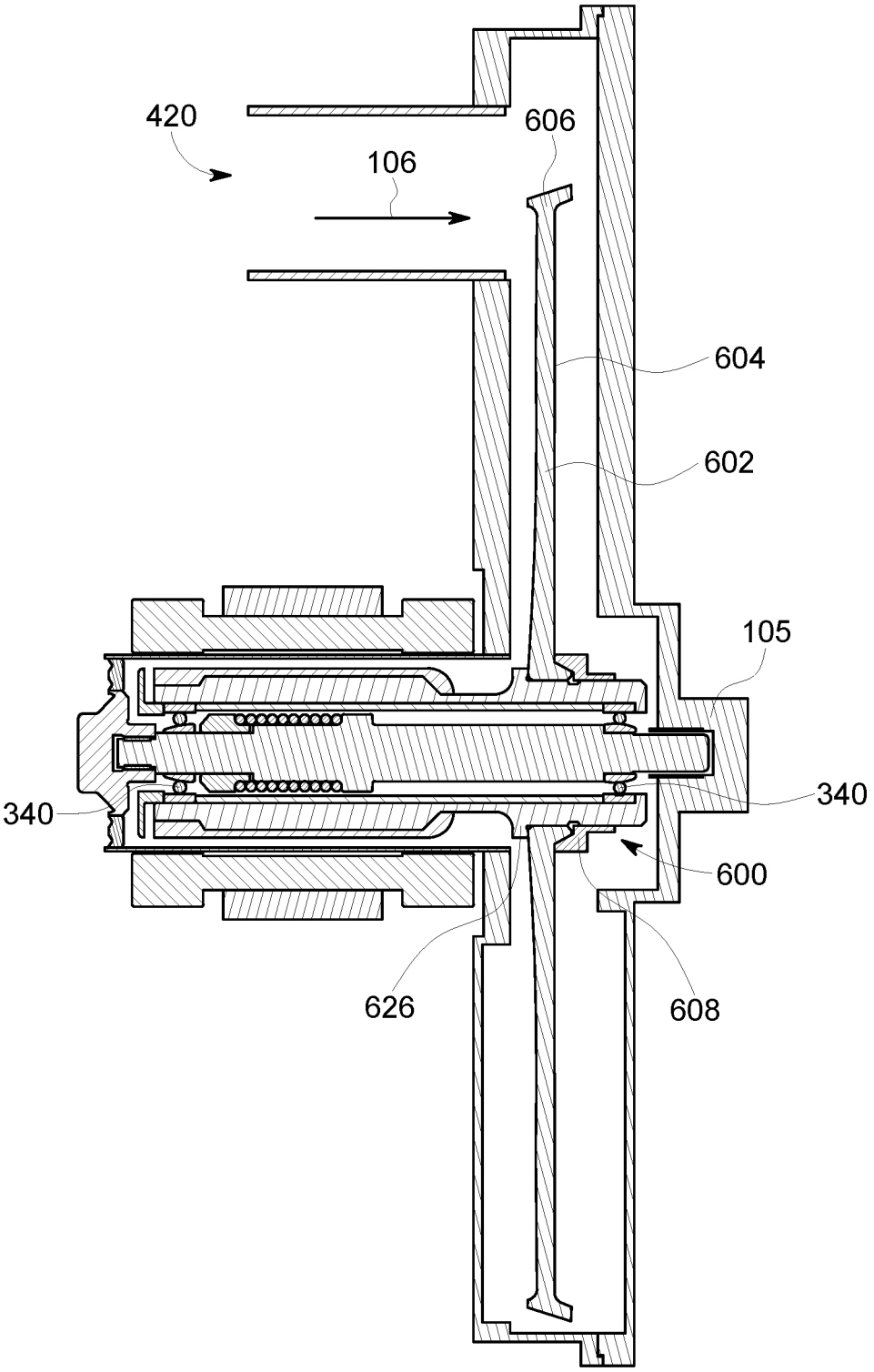
FIG. 5 is a cross-sectional view of an alternative neutron source target within a vacuum chamber housing.

FIG. 5 is a cross-sectional view of an alternative embodiment of a neutron source target 600 within vacuum chamber housing 105. Unless otherwise indicated, components of neutron source target 600 are substantially similar to those of neutron source target 104 (shown in FIGS. 1-4). Neutron source target 600 includes a disk 602 including a body 604 and a rim 606. As compared to disk 202, body 604 has a thinner profile, reducing a weight of disk 602 and associated loads on bearing assemblies 340.

Figure 6:
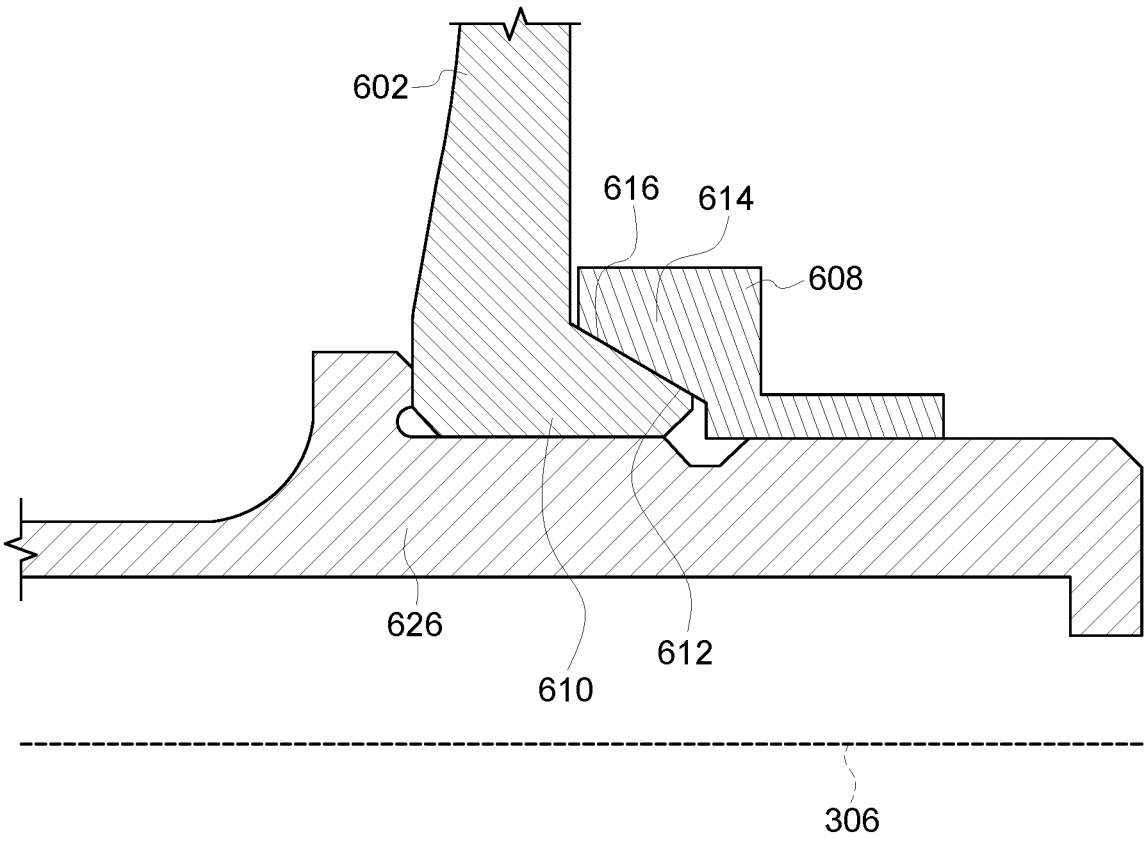
FIG. 6 is an enlarged view of a portion of the neutron source target source shown in FIG. 5.

Similar to nut 208 (shown in FIGS. 2-4), a nut 608 secures disk 602 to a motor core 626. In this embodiment, however, nut 608 secures disk 602 using a conical mounting configuration. For example, FIG. 6 is an enlarged view of the engagement between nut 608, disk 602, and motor core 626. As shown in FIG. 6, disk 602 includes a first conical portion 610 having a first tapered surface 612, and nut 608 includes a second conical portion 614 having a second tapered surface 616. First and second tapered surfaces 612 and 616 may be oriented, for example, at approximately 30° relative to longitudinal axis 306. When nut 608 is tightened on motor core 626, tapered surfaces 616 and 616 engage one another, securing disk 602. Further, given the arrangement of nut 608 and disk 602, if first conical portion 610 expands (e.g., due to thermal or rotational stresses), second conical portion 614 of nut 608 clamps disk 602 tighter.

The embodiments described herein include an apparatus that may be used with a compact neutron source. The apparatus includes a compact vacuum chamber housing defining a vacuum chamber and an ion beam inlet. The apparatus further includes a rotating target positioned within the vacuum chamber. The ion beam inlet is oriented to receive ions such that the ions impinge upon the rotating target. The apparatus further includes a motor core positioned within the vacuum chamber and coupled to the rotating target, and a motor stator electromagnetically coupled with the motor core.

An exemplary technical effect of the methods, systems, and apparatus described herein includes at least one of: (a)

providing a compact neutron source target; (b) improving thermal load dissipation of a neutron source target; and (c) reducing mass of a neutron source target.

Exemplary embodiments of a neutron source target are described herein. The systems and methods of operating and manufacturing such systems and devices are not limited to the specific embodiments described herein, but rather, components of systems and/or steps of the methods may be utilized independently and separately from other components and/or steps described herein. For example, the methods may also be used in combination with other electronic system, and are not limited to practice with only the electronic systems, and methods as described herein. Rather, the exemplary embodiment can be implemented and utilized in connection with many other electronic systems.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A portable neutron generator comprising:

a vacuum chamber housing defining a vacuum chamber and an ion beam inlet, wherein the vacuum chamber is passively cooled without the use of liquid cooling;

a rotating target positioned within the vacuum chamber, the ion beam inlet oriented to receive ions such that the ions impinge upon the rotating target to cause neutrons to be emitted, wherein the rotating target comprises a copper alloy;

a motor core positioned within the vacuum chamber and coupled to the rotating target, wherein the motor core is configured to rotate the rotating target at greater than 200 Hz during operation; and a motor stator electromagnetically coupled with the motor core.

2. The portable neutron generator of claim 1, wherein the rotating target comprises a rotating disk having a coating to convert received ions into neutrons.

3. The portable neutron generator of claim 2, wherein the coating comprises titanium.

4. The portable neutron generator of claim 3, wherein the coating comprises titanium deuteride.

5. The portable neutron generator of claim 2, wherein the copper alloy comprises a copper zirconium (Cu—Zr) alloy or a copper chromium zirconium (Cu—Cr—Zr) alloy.

6. The portable neutron generator of claim 5, wherein the rotating disk further comprises an annular body and a rim integrally formed with the annular body and radially outward of the annular body.

7. The portable neutron generator of claim 1, wherein the motor core is supported by liquid metal bearings.

8. The portable neutron generator of claim 1, wherein the motor stator comprises permanent magnets.

9. The portable neutron generator of claim 1, wherein the vacuum chamber contains no rotating seals.

10. The portable neutron generator of claim 1, wherein the vacuum chamber housing is configured to maintain a vacuum at a pressure of 10e-3 Torr or less in the vacuum chamber.

11. The portable neutron generator of claim 1, further comprising a nut that secures the motor core to the rotating target using a conical mounting configuration.

12. A portable neutron generator comprising:

an ion source;

an ion accelerating structure coupled to the ion source;

a vacuum chamber housing coupled to the ion accelerating structure, wherein the vacuum chamber housing defines a vacuum chamber and an ion beam inlet, wherein the ion source, the ion accelerating structure, and the vacuum chamber housing cooperatively define a sealed vacuum environment including the vacuum chamber, and wherein the vacuum chamber is passively cooled without the use of liquid cooling;

a rotating target positioned within the vacuum chamber, the ion beam inlet oriented to receive ions such that the ions impinge upon the rotating target to cause neutrons to be emitted, wherein the rotating target comprises a copper alloy;

a motor core positioned within the vacuum chamber and coupled to the rotating target, wherein the motor core is configured to rotate the rotating target at greater than 200 Hz during operation; and a motor stator electromagnetically coupled with the motor core.

13. The portable neutron generator of claim 12, wherein the rotating target comprises a rotating disk having a coating to convert received ions into neutrons.

14. The portable neutron generator of claim 13, wherein the coating comprises titanium deuteride.

15. The portable neutron generator of claim 13, wherein the copper alloy comprises a copper zirconium (Cu—Zr) alloy or a copper chromium zirconium (Cu—Cr—Zr) alloy.

16. The portable neutron generator of claim 12, wherein the motor stator comprises permanent magnets.

17. The portable neutron generator of claim 12, wherein the vacuum chamber contains no rotating seals.

18. The portable neutron generator of claim 12, wherein the vacuum chamber housing is configured to maintain a vacuum at a pressure of 10e-3 Torr or less in the vacuum chamber.

* * * * *